US005410457A

United States Patent [19]

Parker

[11] Patent Number: 5,410,457

[45] Date of Patent: Apr. 25, 1995

[54] SMALL-SIZED VERSATILE-USE FLASHLIGHT

[76] Inventor: David H. Parker, 2255 Jefferson St., Torrance, Calif. 90501

[21] Appl. No.: 85,108

[22] Filed: Jul. 2, 1993

[51] Int. Cl.[6] ..... F21L 7/00

[52] U.S. Cl. ..... 362/205; 362/197; 362/199; 362/200

[58] Field of Search ..... 362/197, 199, 200, 205, 362/287, 419, 427, 194, 190, 275

[56] References Cited

U.S. PATENT DOCUMENTS

| | | | |
|---|---|---|---|
| 2,611,072 | 9/1952 | Potekin | 362/199 |
| 2,861,174 | 11/1958 | Talbot et al. | 362/199 |
| 2,921,182 | 1/1960 | Taylor | 362/199 |
| 3,084,248 | 4/1963 | Packer et al. | 362/199 |
| 3,601,595 | 8/1971 | Kivela | 362/199 |
| 4,459,646 | 7/1984 | Drane | 362/200 |
| 4,581,686 | 4/1986 | Nelson | 362/205 |

FOREIGN PATENT DOCUMENTS

| | | | |
|---|---|---|---|
| 854077 | 11/1960 | Hong Kong | 362/197 |
| 6509430 | 4/1966 | Netherlands | 362/200 |
| 5506 | of 1914 | United Kingdom | 362/200 |
| 564385 | 9/1944 | United Kingdom | 362/199 |

*Primary Examiner*—Ira S. Lazarus
*Assistant Examiner*—Y. Quach
*Attorney, Agent, or Firm*—Matthew P. Lynch

[57] ABSTRACT

A small-sized versatile-use flashlight which has a hand holdable battery housing with a cap being pivotally mounted on said housing. Within the cap is included appropriate electrical connections to supply battery power to a light bulb mounted within a light bulb housing. The light bulb housing is pivotally mounted onto the cap with the plane of the pivotal movement of the light bulb housing being perpendicular to the plane of the pivotal movement of the cap relative to the battery housing.

5 Claims, 1 Drawing Sheet

SMALL-SIZED VERSATILE-USE FLASHLIGHT

BACKGROUND OF THE INVENTION

1. Field of the Invention

The field of this invention is directed to flashlights and more particularly to a small, light in weight, flashlight which can be moved to positions to project the light beam in various directions to facilitate observation of dark confined areas.

2. Description of the Prior Art

Flashlights have long been known. There have been flashlights of all sizes and shapes constructed in the past. For working people such as plumbers, electricians and other similar types of people find themselves at times working in very confined quarters. These confined quarters are frequently found in conjunction with equipment such as air conditioning units, furnaces, automobile engines and so forth. In certain instances it is necessary to observe a specific small confined area. Some flashlights in the past are just too big and are not able to be placed directly adjacent the confined area in order to illuminate the confined area. Also, at times, in order to illuminate the confined area, it may be necessary to insert the flashlight first into the confined area and then move the light bulb to direct the light to the desired location.

In most flashlights, it is not permitted to move the light bulb relative to the housing of the flashlight. The flashlight is constructed as a single solitary unit with no movement between the light bulb and the body of the flashlight being permitted.

SUMMARY OF THE INVENTION

The primary objective of the present invention is to construct a small hand holdable flashlight that produces a high intensity light where the flashlight can be conveniently used to illuminate confined quarters such as is generally found in conjunction with equipment.

Another objective of the present invention is to create a flashlight which can be positioned in one configuration during locating of the flashlight at the desired area to be illuminated and then maneuver the flashlight into another configuration to achieve illumination of a "nook or granny" that would previously be very difficult or impossible to illuminate.

Another objective of the present invention is to construct a small flashlight which can be conveniently mounted on an exterior structure in a location that facilitates its usage.

The flashlight of the present invention comprises a battery housing which has a single access opening so as to prevent entry and removal of the battery or batteries within the battery housing. The access opening is normally closed by a cap with this cap being pivotally mounted about a first pivot axis relative to the battery housing. A latching device interconnects between the cap and the battery housing in order to latch the cap in the closed position. Within the interior of the cap are appropriate electrical connections to supply electricity to a light bulb contained within a light bulb housing. This light bulb housing is located separate from the cap with this light bulb housing is pivotally movable relative to the cap about a second pivot axis. This second pivot axis is perpendicular to the first pivot axis. The light bulb housing is capable of being pivoted approximately one hundred and eighty degrees relative to the cap even when the light bulb is illuminated.

DETAILED DESCRIPTION OF THE SHOWN EMBODIMENT

Figure 1:
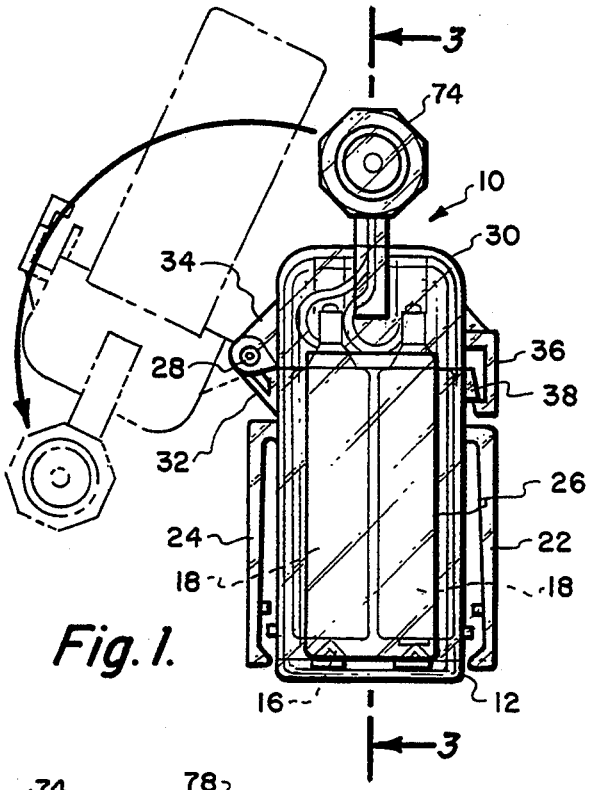
FIG. 1 is a front plan view of the flashlight of the present invention depicting the range of movement of the cap relative to the battery housing.

Referring particularly to the drawing, there is shown the flashlight 10 of the present invention. The flashlight 10 is constructed principally of a plastic material with possibly a transparent plastic material being preferred. The flashlight 10 includes a battery housing 12 which has an internal compartment 14. At the bottom of the internal compartment 14 is an appropriate metallic electrically conducted electrical contact 16. The contact 16 is to connect with a pair of cylindrically shaped small batteries 18. The upper end of the batteries are located directly adjacent the access opening 20 providing access into the internal compartment 14.

Mounted on the exterior surface of the sidewalls of the battery housing 12 are a pair of clips 22 and 24. Mounted also on the backwall of the battery housing 12 is a third clip 26. It is the functions of the clips 22, 24 and 26 to facilitate attachment to an exterior structure such as to a pair of trousers, a shirt pocket, a tool box or other similar type of exterior structure.

Pivotally mounted about a first pivot axis by means of a joint 28 to the battery housing 12 is a cap 30. The joint 28 is formed by connecting together protrusions 32 and 34 with protrusion 32 being integrally connected to the battery housing 12 and protrusion 34 being integrally connected to the cap 30. The opposite side of the cap 30 includes a latch member 36. The latch member 36 is to latchingly engage with a protrusion 38 formed on the battery housing 12 which will securely latch together the cap 30 and the battery housing 12 when the cap 30 is in the closed position. Manual disengagement of the latch 36 will permit the cap 30 to be pivoted to the dotted line position shown in FIG. 1. This will permit the batteries 18 to be removed and replaced.

The interior of the cap 30 includes an internal chamber 40. Within this internal chamber 40 and integrally formed with the cap 30 are a pair of spaced apart protrusions 42 and 44. Protrusion 42 connects with an electrically conductive coil spring 46. Protrusion 44 connects with an electrically conductive coil spring 48. Spring 46 connects with one of the batteries 18 and spring 48 connects with the other of the batteries 18. Electrically connected to the spring 48 is an electrically conducting wire 52. A separate electrically conducting wire 50 connects to the spring 46. The wires 50 and 52 are conducted through rod 54. Rod 54 has its inner end integrally formed into a circular cup 56 which is located within the internal chamber 40. Integrally fixed to the center of cup 56 is a shaft 58. Shaft 58 is mounted in a close conforming manner within holes formed within plates 60 and 62 respectively which are integral with the cap 30. There is a slot 64 formed within the upper end of the cap 30. The rod 54 is movable within the slot 64 almost one hundred and eighty degrees as is shown within FIG. 2 of the drawing. This movement is permitted about the pivot axis that is created by shaft 58 relative to the plates 60 and 62. As is observed in FIG. 3, the pivot axis of shaft 58 lies within the plane of the longitudinal center axis of the batteries 18. In other words, the longitudinal center axis of each battery 18 intersects the pivot axis of shaft 58.

Electrical conducting wire 50 is connected to center conductor 66. Electrical conductor 52 is connected to sidewall conductor 68. Connecting sidewall conductor 68 is a coil spring 70. Engaging with the coil spring 70 is a light bulb 72. The light bulb 72 is mounted within a closure cap 74. The outer end of the closure cap 74 includes a lens 76. The closure cap 74 is threadably mounted onto an extension 78 of the rod 54.

Tightening of the threaded connection between the closure cap 74 and extension 78 will cause the inner end of the light bulb 72 to come into contact with the center conductor 66. This will complete the electrical connection with the light bulb 72 and the light bulb 72 will be activated. The rod 54, the extension 78 and the closure cap 74 constitute the light bulb housing.

It is to be understood that activation of the light bulb 72 is to occur by merely tightening of the threaded connection between the closure cap 74 and the extension 78 until the inner end of the light bulb 72 comes in contact with the center conductor 66. By loosening of the closure cap 74 on the extension 78 and causing the light bulb 72 to be spaced from the center conductor 66, the light bulb 72 will be deactivated.

It is to be understood that the pivot axis about the shaft 58 is perpendicular to the pivot axis about the joint 28. In other words, the plane of movement of the cap 30 relative to the battery housing 12 is perpendicular to the plane of movement of the closure cap 74 relative to the cap 30.

Figure 2:
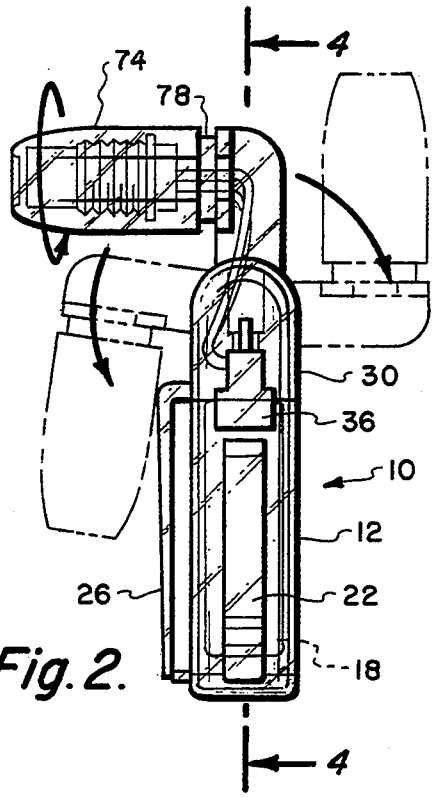
FIG. 2 is a right side elevational view of the flashlight of the present invention depicting the range of motion of the light bulb housing relative to the cap and battery housing of the flashlight of the present invention.
Figure 3:
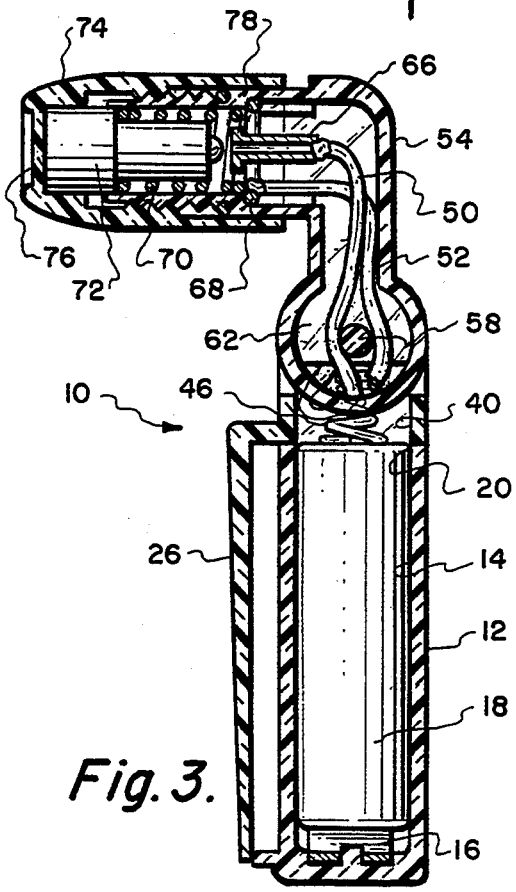
FIG. 3 is a cross-sectional view taken along line 3—3 of FIG. 1.
Figure 4:
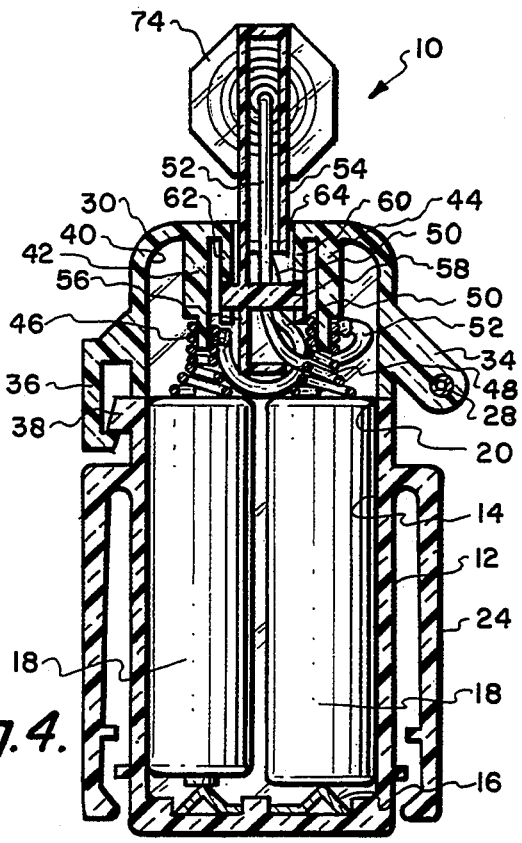
FIG. 4 is a cross-sectional view generally from a rearward direction of the flashlight of the present invention taken along line 4—4 of FIG. 2.

One desirable feature of the flashlight 10 of the present invention is that the battery housing 12 can be held in one's hand and the forefinger of the hand can be utilized to position the light bulb housing in any position between the dotted line position shown in FIG. 2. These dotted line positions constitute almost one hundred eighty degrees of movement. This is a particularly desirable feature of the present invention so as to permit the high intensity light of the flashlight of this invention to be utilized in exceedingly cramped close quarter situations such as in conjunction with the engine of an automobile, the internal components of an air conditioner or other similar type of environments.

What is claimed is:

1. A flashlight comprising:

a battery housing having an internal compartment, said internal compartment being adapted to connect with an electrical battery, said internal compartment having a longitudinal center axis, a single access opening permitting access into said internal compartment;

a cap mounted on said battery housing, said cap being movable within a first plane between an open position and a closed position, said open position permitting access into said internal compartment, said closed position preventing access into said internal compartment;

a light bulb mounted in a light bulb housing, said light bulb housing being mounted on said cap, said light bulb housing being pivotally movable within a second plane approximately one hundred and eighty degrees on said cap, said light bulb housing being pivotable about a pivot axis which intersects a longitudinal center axis of said battery;

electrical connection means mounted within said cap, said electrical connection means connected to said battery for transmitting electrical current to activate said light bulb; and whereby said battery housing is to be held in one hand of a human user with the forefinger of the hand to be utilized to move the light bulb housing to assume any position within almost one hundred and eighty degrees of movement.

2. The flashlight as defined in claim 1 including:

said light bulb covered by a closure cap, said closure cap being threadably secured to said light bulb housing, threadably tightening of said closure cap on said light bulb housing causes activation of said light bulb, threadably loosening of said closure cap on said light bulb housing causes deactivation of said light bulb.

3. The flashlight as defined in claim 2 wherein:

a latching means interconnecting said cap and said battery housing, said latching means functioning to securely lock said cap onto said battery housing when said cap is in said closed position.

4. The flashlight as defined in claim 3 wherein:

said first plane being perpendicular to said second plane.

5. The flashlight as defined in claim 4 including:

said battery housing including clip means, said clip means facilitating a mounting of said flashlight onto an exterior structure.

* * * * *